US009018553B1

(12) United States Patent
Arnold et al.

(10) Patent No.: US 9,018,553 B1
(45) Date of Patent: Apr. 28, 2015

(54) REDUCING BIASING FORCES WITHIN A SEALING DEVICE

(75) Inventors: John K. Arnold, Dumont, NJ (US); Kenneth J. Schwinn, West New York, NJ (US); Danny Lawrence, Paterson, NJ (US)

(73) Assignee: A.P.M. Hexseal Corporation, Englewood, NJ (US)

( * ) Notice: Subject to any disclaimer, the term of this patent is extended or adjusted under 35 U.S.C. 154(b) by 71 days.

(21) Appl. No.: 13/557,379

(22) Filed: Jul. 25, 2012

(51) Int. Cl.
*H01H 19/06* (2006.01)
*H01H 23/06* (2006.01)
*H01H 11/00* (2006.01)

(52) U.S. Cl.
CPC ..... *H01H 23/06* (2013.01); *H01H 11/00* (2013.01)

(58) Field of Classification Search
CPC ..... H01H 9/04; H01H 13/06; H01H 19/06; H01H 13/04; H01H 3/00; H01H 13/00
USPC ..... 200/302.3, 302.1, 333, 339
See application file for complete search history.

(56) References Cited

U.S. PATENT DOCUMENTS 2,440,943 A 5/1948 Gonsett et al.
2,462,023 A 2/1949 Johanson et al.
3,322,445 A 10/1964 Hassan
3,316,379 A * 4/1967 Clarke et al. ..... 200/333
3,431,811 A 3/1969 Yonkers
3,928,742 A 12/1975 Rule
4,178,806 A 12/1979 Morse
4,298,778 A 11/1981 Beresford-Jones
4,482,792 A * 11/1984 Geremia ..... 200/302.3
4,673,780 A 6/1987 Kenway
5,671,840 A * 9/1997 Glicksman ..... 200/302.3
5,788,059 A 8/1998 Jahangiri
7,964,812 B1 6/2011 Schwinn

* cited by examiner

*Primary Examiner* — Edwin A. Leon
*Assistant Examiner* — Anthony R. Jimenez
(74) *Attorney, Agent, or Firm* — Arthur Jacob

(57) ABSTRACT

A device and method are disclosed for use in sealing a toggle-operated apparatus mounted upon a panel. The actuator of the apparatus initially is in an operating position extending along a given axial direction and is movable through angular displacement away from that orientation into another operating position, by an operating force applied in a transverse direction. A boot member of the device is constructed of a resiliently flexible elastomeric material and includes an apical section for placement over the actuator upon sealing the apparatus, and an intermediate section configured and dimensioned to facilitate angular displacement of the apical section, along with angular displacement of the actuator to operate the apparatus, while reducing any resulting resilient biasing force tending to return the apical section toward orientation in the given axial direction to less than any transversely directed force capable of moving the actuator out of the another operating position.

17 Claims, 4 Drawing Sheets

REDUCING BIASING FORCES WITHIN A SEALING DEVICE

The present invention relates generally to a sealing device and method for use in providing a protective seal over a toggle-operated apparatus, such as a toggle switch, usually mounted upon a panel and pertains, more specifically, to a protective boot construction for accommodating toggle-operated apparatus, such as toggle switches, and which are actuated in response to relatively low actuating forces.

It has become commonplace to employ sealing devices for toggle-operated apparatus, such as toggle switches, where it is desired to provide for protection against environmental hazards in the vicinity of a toggle-operated apparatus installation. In particular, protective boots have been made available for ready fitting over toggle switches of the type ordinarily mounted upon a panel, with the switch boot installed over the actuator of the switch. These switch boots usually are constructed of a resiliently flexible elastomeric material and include an apical section for placement over the switch actuator which, in a toggle switch, is in the form of a toggle handle. The elastomeric material serves to isolate the switch from the surrounding environment while the resiliently flexible nature of the material enables ready selective movement of the apical section for manipulating the actuator into and out of available operating positions.

Many currently available toggle switches, as well as other toggle-operated devices, now are constructed for actuation in response to the application of relatively low actuation forces to the actuator of the device. It has been found that upon fitting any one of a variety of conventional, currently available protective sealing devices over such a toggle switch, the resiliently flexible nature of the material of the sealing device, while allowing ready flexing movement of a switch boot out of one operating position and into another operating position in response to a force of sufficient magnitude applied to the switch actuator, will create a resilient biasing force in the switch boot tending to return the switch actuator to the original operating position, and that return biasing force is great enough to move the switch actuator back to the original position, once the actuating force is removed. This results in the unwanted consequence wherein the switch, once actuated, will not remain actuated, due to the biasing force created in the switch boot, which biasing force simply returns the switch actuator to the original position. Thus, a switch may be actuated from an "OFF" condition to an "ON" condition by applying a sufficient actuating force through the switch boot to the switch actuator, but will not remain "ON" once that actuating force is removed, since the resilient biasing force will return the switch to the "OFF" condition, creating an unwanted consequence. Proposals toward modifying the composition or the construction of the switch boot heretofore have met with little success in that such modifications either can increase the complexity of the construction of a sealing device, or have had negative effects on maintaining sealing integrity, overall performance, and longevity.

The present invention provides a sealing device and a sealing method that overcome the drawbacks outlined above. As such, the present invention attains several objects and advantages, some of which are summarized as follows: Effectively seals a toggle-operated apparatus, such as a toggle switch, against surrounding environmental conditions without affecting the ability to actuate the apparatus in response to the application of an actuating force, while assuring that the apparatus will remain so actuated upon removal of the actuation force; provides a switch boot that seals a switch against surrounding environmental conditions without interfering with the intended operation of the switch; provides a protective boot constructed of a resiliently flexible elastomeric material for sealing a toggle-operated apparatus while allowing the apparatus to be actuated from one operating condition to another without creating a biasing force in the protective boot sufficient to return the apparatus to the one operating condition; enables a switch boot construction of proven effectiveness and reliability to be adapted for use in connection with currently available switches in which actuating forces are reduced in comparison to previously available switches of similar type, and without departing widely from currently accepted conventional sealing devices and methods for sealing switches; provides a sealing device of relatively simple construction, capable of economical manufacture in large numbers of uniform, high quality; adapts readily to switches and switch installations currently in use without requiring modification of such switches or switch installations; provides versatility for serving to seal a wide variety of toggle-operated apparatus currently encountered in installations in the field; maintains a high degree of integrity for exemplary performance over an extended service life.

The above objects and advantages, as well as further objects and advantages, are attained by the present invention, which may be described briefly as a sealing device for use in connection with a toggle-operated apparatus mounted upon a panel and having an actuator normally placed in an initial operating position wherein the actuator extends along a given axial direction away from the panel, the actuator being selectively movable in an angular displacement away from orientation in the given axial direction and into another operating position, in response to an operating force applied to the actuator in a transverse direction, transverse to the given axial direction, the sealing device comprising: a boot member having a wall constructed of a resiliently flexible elastomeric material, the boot member including a lower basal section for establishing a seal at the panel, an upper apical section for establishing a seal at the actuator, and an intermediate section located axially between the basal section and the apical section, the intermediate section including a substantially axially extending, transversely inner wall portion juxtaposed with the apical section; a substantially axially extending, transversely outer wall portion spaced transversely outwardly from the inner wall portion by a transverse spacing; and an intermediate wall portion having a substantially frusto-conical configuration spanning the transverse spacing and extending along an oblique direction with respect to the axial direction, from an axially upper end of the outer wall portion to an axially lower end of the inner wall portion, the wall portions providing the intermediate section with a cross-sectional configuration in axial planes shaped and dimensioned to facilitate an angular displacement of the apical section, along with said selective angular displacement of the actuator, while reducing any resulting resilient biasing force within the boot member tending to return the apical section toward orientation in the given axial direction to less than any transversely directed force capable of moving the actuator out of the another operating position and toward the initial operating position, oriented in the given axial direction.

In addition, the present invention provides a sealing method for use in connection with sealing a toggle-operated apparatus with a sealing device, the toggle-operated apparatus being mounted upon a panel and having an actuator normally placed in an initial operating position wherein the actuator extends along a given axial direction away from the panel, the actuator being selectively movable in an angular displacement away from orientation in the given axial direction and into another operating position, in response to an operating force applied to the actuator in a transverse direction, transverse to the given axial direction, the sealing method comprising: providing a boot member having a wall constructed of a resiliently flexible elastomeric material, the boot member including a lower basal section for establishing a seal at the panel, an upper apical section for establishing a seal at the actuator, and an intermediate section located axially between the basal section and the apical section, and providing the intermediate section with a substantially axially extending, transversely inner wall portion juxtaposed with the apical section; a substantially axially extending, transversely outer wall portion spaced transversely outwardly from the inner wall portion by a transverse spacing; and an intermediate wall portion having a substantially frusto-conical configuration spanning the transverse spacing and extending along an oblique direction with respect to the axial direction, from an axially upper end of the outer wall portion to an axially lower end of the inner wall portion, the wall portions providing the intermediate section with a cross-sectional configuration shaped and dimensioned to facilitate an angular displacement of the apical section, along with said angular displacement of the actuator, while reducing any resulting resilient biasing force within the boot member tending to return the apical section toward orientation in the given axial direction to less than any transversely directed force capable of moving the actuator out of the another operating position and toward initial operating position oriented in the given axial direction; placing the boot member over the actuator; and securing the sealing device over the toggle-operated apparatus.

The invention will be understood more fully, while still further objects and advantages will become apparent, in the following detailed description of preferred embodiments of the invention illustrated in the accompanying drawing, in which.

Figure 1:
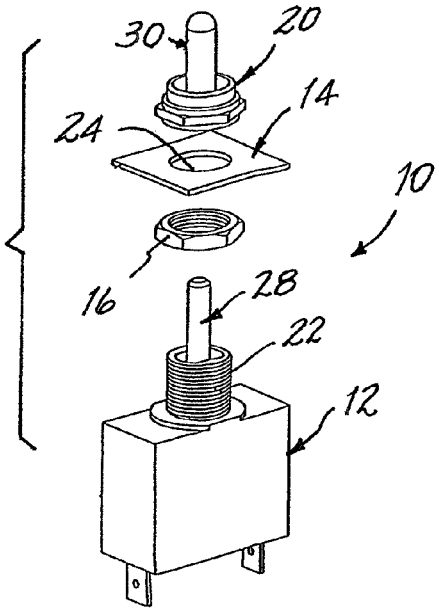
FIG. 1 is an exploded pictorial view illustrating the use of a sealing device constructed in accordance with the present invention.
Figure 2:
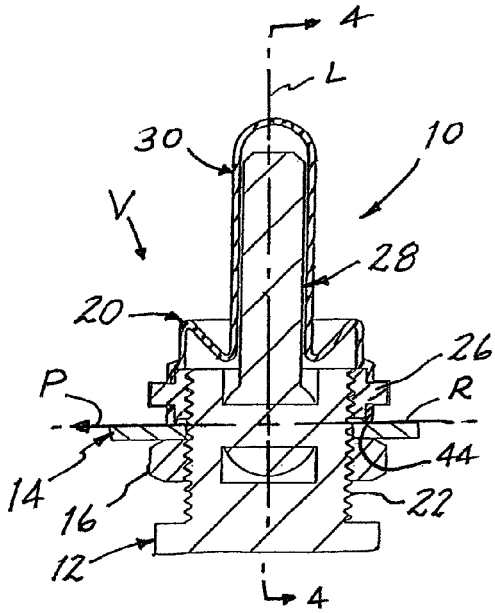
FIG. 2 is a somewhat diagrammatic longitudinal cross-sectional view showing the sealing device installed over a mounted switch.

Referring now to the drawing, and especially to FIGS. 1 and 2 thereof, a toggle-operated apparatus installation 10 is seen to include a toggle-operated apparatus in the form of a conventional toggle switch 12, for mounting upon a panel 14, utilizing a backing nut 16 and a sealing device 20 constructed in accordance with the present invention. Switch 12 includes a threaded bushing 22 that receives backing nut 16 and is projected through an aperture 24 in panel 14 to receive a threaded sealing nut 26 which comprises a component part of sealing device 20 and serves to secure switch 12 to panel 14, with the panel 14 captured between backing nut 16 and sealing nut 26, as illustrated in FIG. 2. Switch 12 includes an actuator, shown in the form of a toggle handle 28 extending in an axial direction, aligned along a longitudinal axis L, away from panel 14 so as to be available for movement by an actuating force F (see FIG. 4) in a rotational motion about a transverse axis shown in the form of lateral axis R, to be displaced by rotation through angular displacement away from the axial direction, as will be described in greater detail below.

Figure 3:
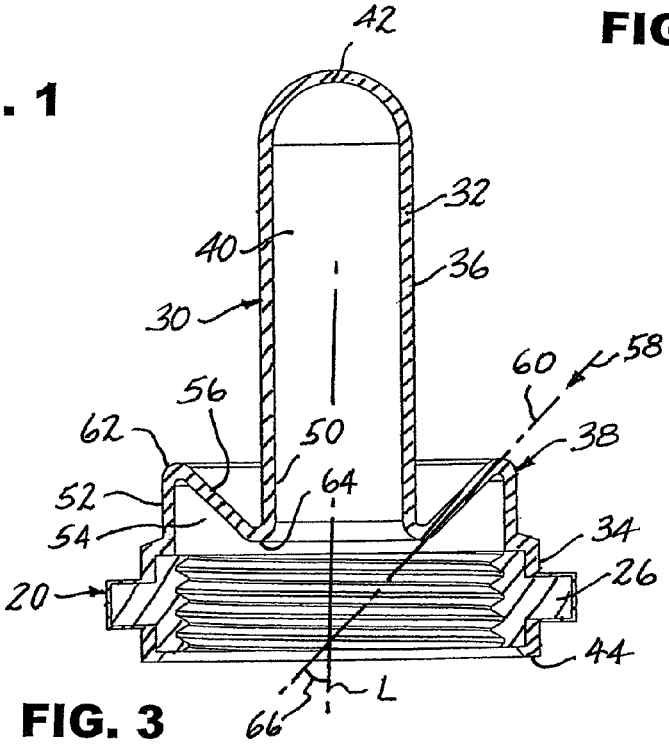
FIG. 3 is an enlarged longitudinal cross-sectional view of the sealing device.

In order to protect switch 12 against environmental conditions in the vicinity V adjacent panel 14, sealing device 20 is installed over switch 12. As best seen in FIG. 3, as well as in FIGS. 1 and 2, sealing device 20 includes a boot member 30 having a wall 32 constructed of a resiliently flexible elastomeric material, such as a silicone rubber. Boot member 30 includes a lower basal section, shown in the form of a sheath 34 surrounding sealing nut 26, an upper apical section, shown in the form of a generally cylindrical sleeve 36, and an intermediate section, in the form of an annulus 38 located axially between the sheath 34 and the sleeve 36. In the illustrated preferred construction, all of the sections of boot member 30 are molded together in a unitary boot member structure. Sleeve 36 includes an inner chamber 40 closed at the top 42 of the sleeve 36 and configured and dimensioned to receive and enclose toggle handle 28 within sealing device 20, when sealing device 20 is installed over switch 12, as illustrated in FIG. 2, wherein toggle handle 28 is shown extending axially along longitudinal axis L, oriented substantially perpendicular to panel 14. In the illustrated orientation, toggle handle 28 is in an initial operating position, in this instance the initial operating position being a neutral or "OFF" position, and sleeve 36 likewise is oriented to extend axially along longitudinal axis L so as to mimic the orientation of toggle handle 28 and enclose toggle handle 28, as shown. With sealing nut 26 threaded along bushing 22 to secure switch 12 to panel 14, a lowermost sealing surface 44 of sheath 34 is engaged with panel 14 to complete the installation, with an effective seal over switch 12.

Figure 4:
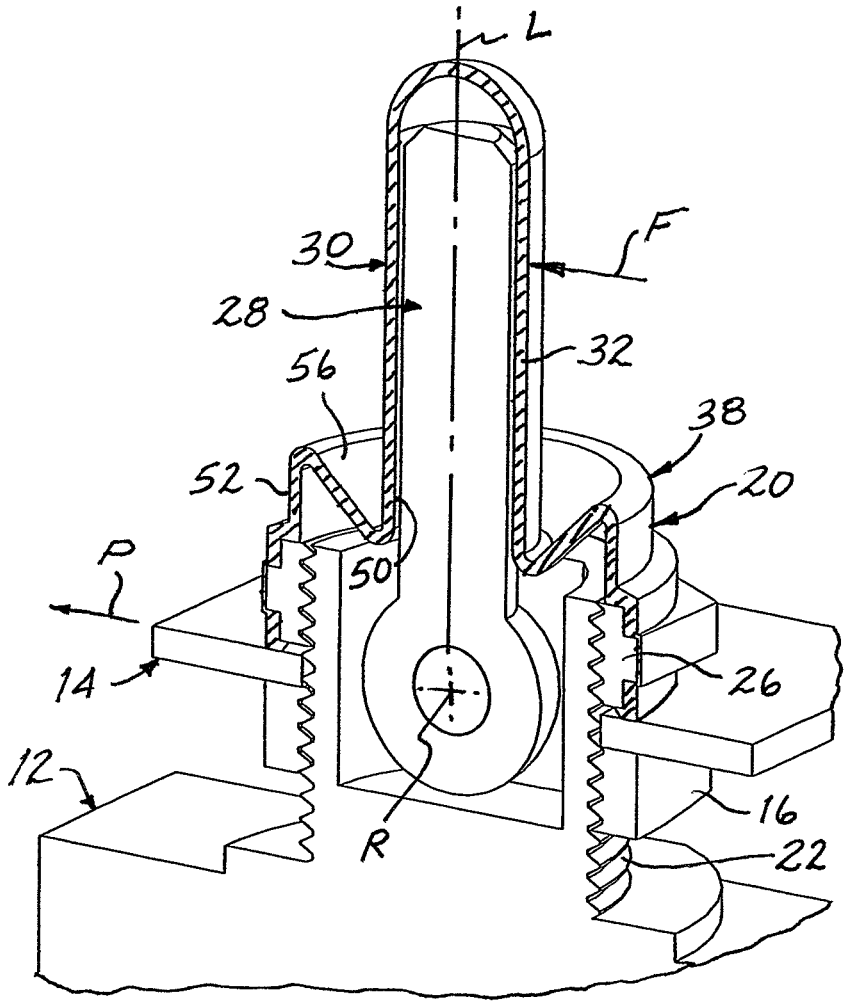
FIG. 4 is a further enlarged, somewhat diagrammatic and pictorial cross-sectional view taken along line 4-4 of FIG. 2.
Figure 5:
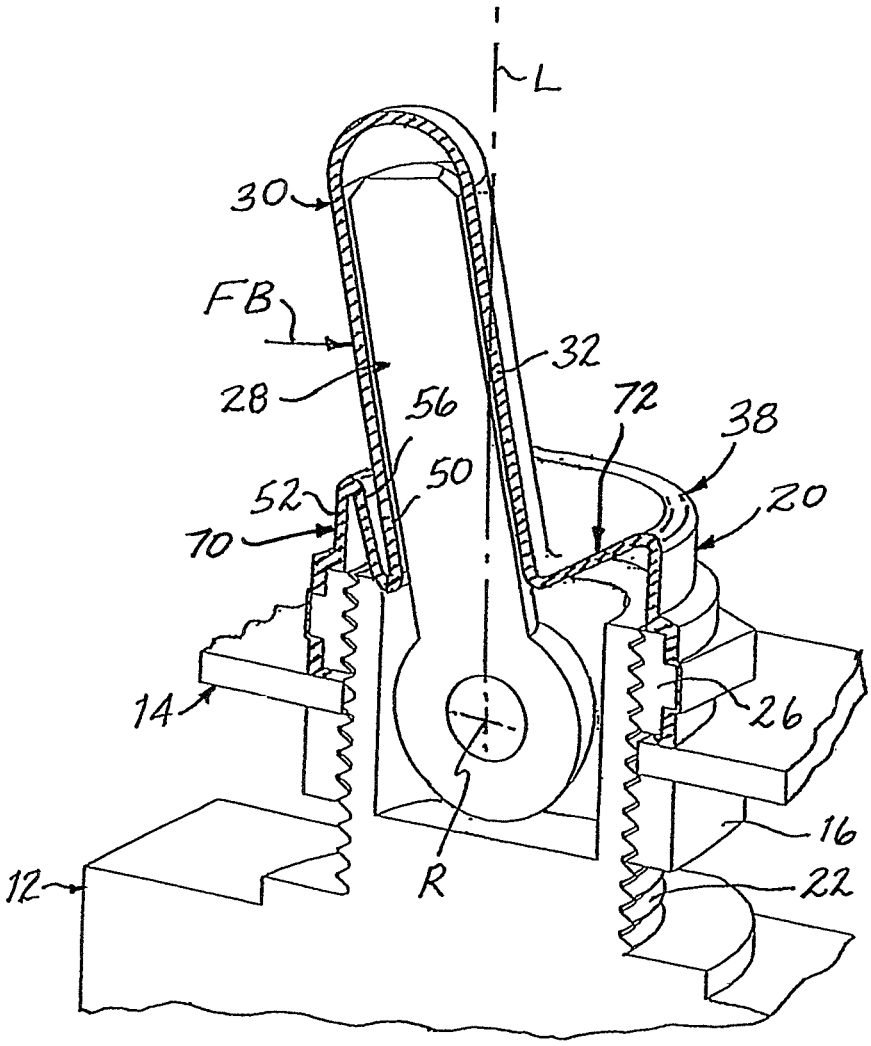
FIG. 5 is a cross-sectional view similar to FIG. 4, and showing component parts in another operating position.

Turning now to FIGS. 4 and 5, switch 12 is of the type which is actuated by applying an actuating force to toggle handle 28, in a direction that will move toggle handle 28 from the initial operating position shown in FIG. 4 as an "OFF" position, wherein switch 12 is in an "OFF" condition, to another operating position, such as an "ON" position illustrated in FIG. 5, wherein the switch 12 is in an "ON" condition. To that end, an actuating force F is applied in a transverse direction, usually manually, to toggle handle 28, through sleeve 36, so that both sleeve 36 and actuating handle 28 are displaced, by rotational movement about lateral axis R, through an angular displacement away from longitudinal axis L, until an "ON" position is reached, in which position switch 12 is in an "ON" condition, and toggle handle 28 is retained in the "ON" position by the internal construction of the switch 12. Upon such angular displacement of toggle handle 28, a corresponding angular displacement of sleeve 36 is accommodated by the resiliently flexible nature of the material of boot member 30 of sealing device 20, which boot member 30 advantageously is molded in a unitary construction of silicone rubber, thereby maintaining the integrity of the seal provided by sealing device 20.

Upon the toggle handle 28 reaching the "ON" position, flexing of the boot member 30 will create a resilient biasing force FB, as shown in FIG. 5, tending to move the sleeve 36 back toward alignment with longitudinal axis L, thus exerting a corresponding laterally directed force upon toggle handle 28. In the construction of earlier switches of a type similar to switch 12, the force required to move an actuating handle is great enough to assure that an actuating handle, once moved to a selected operating position, against the resilient biasing force of a sealing device having a sleeve similar to that of sealing device 20, would remain in the selected operating position. However, with the advent of certain current switches wherein relatively lower actuating forces will move an actuating handle between operating positions, and especially from an operating position corresponding to the illustrated "ON" position, to an operating position corresponding to the illustrated "OFF" position, the resilient biasing force created by displacing an apical section of a prior sealing device corresponding to sealing device 20 has been found to be great enough to move the actuating handle back to the original operating position, creating an unwanted consequence; namely, in the illustrated example, an involuntary turning "OFF" of a switch first turned "ON". The construction of sealing device 20 avoids such an unwanted consequence.

To that end, the intermediate section of boot member 30, illustrated in the form of annulus 38, is provided with a construction that facilitates angular displacement of the sleeve 36 to enable the toggle handle 28 to be moved between operating positions of the toggle handle 28 without creating a resilient biasing force great enough to return the toggle handle 28 to an original operating position after having been displaced angularly to another operating position. At the same time, the salient characteristics of the material of boot member 30, such as strength, resilience and resistance to permeation by environmental conditions, are maintained at a high level. Thus, with reference to FIG. 3, as well as to FIGS. 4 and 5, the wall construction of boot member 30 provides annulus 38 with an inner wall portion 50 that extends substantially axially in juxtaposition with sleeve 36, a substantially axially extending outer wall portion 52 spaced transversely outwardly from the inner wall portion 50 by a transverse spacing 54, and an intermediate wall portion 56 spanning the transverse spacing 54. Intermediate wall portion 56 extends along a substantially frusto-conical configuration that follows an oblique direction 58 with respect to the axial direction of longitudinal axis L, as further represented in FIG. 3 by a line 60, from axially upper end 62 of outer wall portion 52 to axially lower end 64 of inner wall portion 50, the wall portions 50, 52 and 56 thus providing the annulus 38 with a cross-sectional configuration in longitudinal planes (one of which longitudinal planes is in the plane of the paper in FIG. 3) shaped and dimensioned to facilitate angular displacement of sleeve 36 away from orientation in the axial direction, aligned with longitudinal axis L, as illustrated in FIG. 4, along with a corresponding angular displacement of toggle handle 28 from the initial operating position illustrated in FIG. 4 to the actuated operating position illustrated in FIG. 5, while reducing any resulting resilient biasing force created within the boot member 30 and tending to return the sleeve 36 toward orientation in the axial direction aligned with longitudinal axis L, as illustrated by force FB, to less than any magnitude capable of moving the toggle handle 28 out of the operating position illustrated in FIG. 5, back toward alignment with longitudinal axis L and into the original, initial operating position illustrated in FIG. 4.

In the preferred construction, wherein panel 14 extends along a predetermined direction P and switch 12 is provided in a configuration wherein toggle handle 28, when in an original operating position, extends in the axial direction aligned with longitudinal axis L, substantially normal to direction P (also see FIG. 2), sleeve 36, being aligned with longitudinal axis L, also extends substantially normal to direction P. The inner and outer wall portions 50 and 52 are generally cylindrical and are placed coaxial with one another, coextensive along longitudinal axis L such that transverse spacing 54 extends laterally between the inner and outer wall portions 50 and 52, substantially perpendicular to longitudinal axis L. The intermediate wall portion 56 preferably follows a straight frusto-conical configuration, as represented by line 60 which is in the form of a straight line making an acute angle 66 with the longitudinal axis L, the preferred acute angle 66 being about 45°.

As best seen in FIGS. 4 and 5, movement of the sleeve 36 from the position illustrated in FIG. 4 to the position illustrated in FIG. 5, along with toggle handle 28, is accommodated by a mechanism wherein the wall portions 50, 52 and 56 of annulus 38 of boot member 30 are folded upon one another, as seen at 70 in FIG. 5, and unfolded from one another, as seen at 72 in FIG. 5, without excessive bending or stretching of the material of wall 32 of the boot member 30 and the creation of concomitant tensile stresses within the wall portions 50, 52 and 56 themselves. In this manner, resilient biasing forces created within wall 32 of boot member 30 as a result of moving sleeve 36 through angular displacements, as illustrated in FIG. 5, and in a direction tending to return the sleeve 36 toward the position illustrated in FIG. 4, are reduced to below that which could effect movement of the toggle handle 28 back to the position illustrated in FIG. 4 after having been moved to the position illustrated in FIG. 5. In addition, the folding/unfolding mechanism enabled by the cross-sectional configuration of annulus 38, by virtue of enabling angular displacements of sleeve 36 without excessive stresses within wall 32, not only facilitates ease of operation, but enables the use of wall thicknesses throughout wall 32 that provide exemplary sealing while serving to increase longevity for an extended effective service life of sealing device 20.

Figure 6:
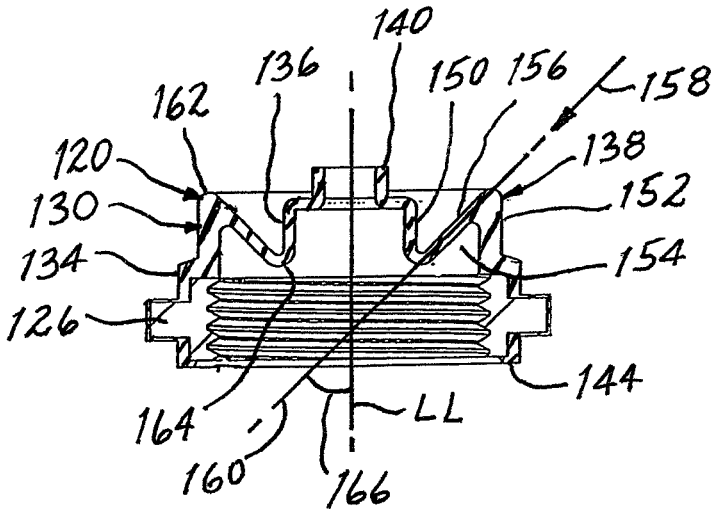
FIG. 6 is a longitudinal cross-sectional view of another sealing device constructed in accordance with the present invention.
Figure 7:
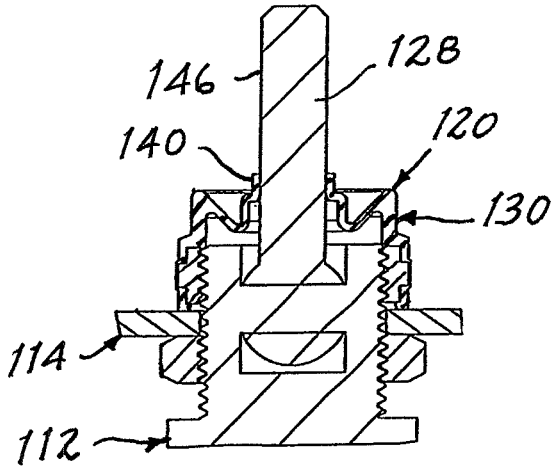
FIG. 7 is a somewhat diagrammatic longitudinal cross-sectional view showing the sealing device of FIG. 6 installed over a mounted switch.

Referring now to FIGS. 6 and 7, another sealing device constructed in accordance with the present invention is shown at 120 and is seen to include a boot member 130 having a wall constructed of a resiliently flexible elastomeric material, such as a silicone rubber. Boot member 130 includes a lower basal section, shown in the form of a sheath 134 surrounding a sealing nut 126, an upper apical section, shown in the form of a cylindrical sleeve 136, and an intermediate section, in the form of an annulus 138 located axially between the sheath 134 and the sleeve 136. In the illustrated preferred construction, all of the sections of boot member 130 are molded together in a unitary boot member structure. Sealing device 120 is constructed to fit over a toggle-operated apparatus, shown in the form of a switch 112, mounted upon a panel 114, in a manner similar to sealing device 20. However, in sealing device 120, sleeve 136 is truncated and includes an open collar 140 configured and dimensioned for gripping toggle handle 128 of switch 112 in a sealing engagement, while a lower sealing surface 144 engages panel 114, to complete a seal over switch 112 upon securing sealing device 120 over switch 112, leaving a portion 146 of toggle handle 128 exposed, as illustrated in FIG. 7, for grasping during actuation of switch 112.

As in the earlier-described embodiment, annulus 138 has an inner wall portion 150, a concentric, coaxial outer wall portion 152 coextensive with and spaced laterally outwardly from the inner wall portion 150 by a transverse spacing 154, and an intermediate wall portion 156 spanning the spacing 154. As before, the intermediate wall portion 156 has a substantially frusto-conical configuration and extends from an upper end 162 of outer wall portion 152 to a lower end 164 of inner wall portion 150, following an oblique direction 158, represented by a straight line 160 making an acute angle 166 of about 45° with a longitudinal axis LL, thus providing annulus 138 with a cross-sectional configuration in longitudinal planes shaped and dimensioned to facilitate angular displacement of sleeve 136, and corresponding movements of toggle handle 128, in the manner described above in connection with sealing device 20.

In order further to facilitate angular displacement of sleeve 136, without the creation of excessive forces as a result of tensile stresses within the wall portions 150, 152 and 156, at least the wall thickness of intermediate wall portion 156, and preferably the wall thickness of both the intermediate wall portion 156 and the inner wall portion 150, is made less than the wall thickness of outer wall portion 152. In this manner, in addition to any bending that may occur in wall portions 150, 152 and 156 during angular displacement of sleeve 136, some further bending can occur in the thinner wall portions to reduce any forces that might be incurred by tensile stresses within these wall portions. While such relatively thinner wall thicknesses are advantageous in sealing device 120, wherein sleeve 136 is truncated and open-ended, in comparison to the extended, closed construction of sleeve 36 of sealing device 20, wall portions 56 and 50 of sealing device 20 likewise may be provided with thinner wall thicknesses than wall portion 52 in order to gain a similar advantage.

It will be seen that the present invention attains all of the objects and advantages summarized above, namely: Effectively seals a toggle-operated apparatus, such as a toggle switch, against surrounding environmental conditions without affecting the ability to actuate the apparatus in response to the application of an actuating force, while assuring that the apparatus will remain so actuated upon removal of the actuation force; provides a switch boot that seals a switch against surrounding environmental conditions without interfering with the intended operation of the switch; provides a protective boot constructed of a resiliently flexible elastomeric material for sealing a toggle-operated apparatus while allowing the apparatus to be actuated from one operating condition to another without creating a biasing force in the protective boot sufficient to return the apparatus to the one operating condition; enables a switch boot construction of proven effectiveness and reliability to be adapted for use in connection with currently available switches in which actuating forces are reduced in comparison to previously available switches of similar type, and without departing widely from currently accepted conventional sealing devices and methods for sealing switches; provides a sealing device of relatively simple construction, capable of economical manufacture in large numbers of uniform, high quality; adapts readily to switches and switch installations currently in use without requiring modification of such switches or switch installations; provides versatility for serving to seal a wide variety of toggle-operated apparatus currently encountered in installations in the field; maintains a high degree of integrity for exemplary performance over an extended service life.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. A sealing device for use in connection with a toggle-operated apparatus mounted upon a panel and having an actuator normally placed in an initial operating position wherein the actuator extends along a given axial direction away from the panel, the actuator being selectively movable in an angular displacement away from orientation in the given axial direction and into another operating position, in response to an operating force applied to the actuator in a transverse direction, transverse to the given axial direction, the sealing device comprising:

a boot member having a wall constructed of a resiliently flexible elastomeric material, the boot member including a lower basal section for establishing a seal at the panel, an upper apical section for establishing a seal at the actuator, and an intermediate section located axially between the basal section and the apical section, the intermediate section including a cylindrical innermost wall portion juxtaposed with the apical section and extending substantially parallel to the axial direction;

a cylindrical outermost wall portion spaced outward from the innermost wall portion in a transverse direction to establish a transverse spacing between the innermost wall portion and the outermost wall portion, with the outermost wall portion extending substantially parallel to the axial direction and surrounding the innermost wall portion; and a single intermediate wall portion having a substantially frusto-conical configuration spanning the transverse spacing and extending along a substantially straight line in an oblique direction making an acute angle with respect to the axial direction, from an axially upper end of the outermost wall portion directly to an axially lower end of the innermost wall portion, the wall portions providing the intermediate section with a cross-sectional configuration in axial planes constructed to fold the inner wall portion and the intermediate wall portion into close juxtaposition with one-another along a folded portion of the intermediate section upon angular displacement of the upper apical section away from orientation in the given axial direction, with the outermost wall portion remaining extended substantially parallel to the axial direction, the folded portion juxtaposed closely with the outermost wall portion and the intermediate wall portion remaining extended along the substantially straight line, while the innermost wall portion, the outermost wall portion and the intermediate wall portion simultaneously are unfolded along a further portion of the intermediate section located transversely opposite from the folded portion, with the outermost wall portion remaining substantially parallel to the axial direction and the intermediate wall portion remaining extended along the substantially straight line, to facilitate angular displacement of the apical section, along with said selective angular displacement of the actuator, thereby reducing any resulting resilient biasing force within the boot member tending to return the apical section toward orientation in the given axial direction to less than any transversely directed force capable of moving the actuator out of the another operating position and toward the initial operating position, oriented in the given axial direction.

2. The sealing device of claim 1 wherein the panel extends along a predetermined direction, the given axial direction extends substantially normal to the predetermined direction, the upper apical section of the boot member extends along a longitudinal axis for alignment with the given axial direction, the innermost and outermost wall portions of the intermediate section are coaxial and coextensive along the longitudinal axis, and the transverse spacing between the innermost and outermost wall portions is a lateral spacing substantially perpendicular to the longitudinal axis.

3. The sealing device of claim 2 wherein the acute angle is about 45°.

4. The sealing device of claim 1 wherein the intermediate section includes a substantially uniform wall thickness along the innermost, outermost and intermediate wall portions.

5. The sealing device of claim 4 wherein the panel extends along a predetermined direction, the given axial direction extends substantially normal to the predetermined direction, the upper apical section of the boot member extends along a longitudinal axis for alignment with the given axial direction, the innermost and outermost wall portions of the intermediate section are coaxial, and the transverse spacing between the innermost and outermost wall portions is a lateral spacing substantially perpendicular to the longitudinal axis.

6. The sealing device of claim 5 wherein the acute angle is about 45°.

7. The sealing device of claim 1 wherein the innermost, outermost and intermediate wall portions of the intermediate section each include a wall thickness, and the wall thickness of at least the intermediate wall portion is less than the wall thickness of the outermost wall portion.

8. The sealing device of claim 7 wherein the panel extends along a predetermined direction, the given axial direction extends substantially normal to the predetermined direction, the upper apical section of the boot member extends along a longitudinal axis for alignment with the given axial direction, the innermost and outermost wall portions of the intermediate section are coaxial, and the transverse spacing between the innermost and outermost wall portions is a lateral spacing substantially perpendicular to the longitudinal axis.

9. The sealing device of claim 8 wherein the acute angle is about 45°.

10. The sealing device of claim 1 wherein the apical section includes a chamber, the chamber being dimensioned and configured for receiving the actuator of the toggle-operated apparatus to enclose the actuator upon mounting the boot member over the toggle-operated apparatus.

11. The sealing device of claim 10 including a sealing surface on the basal section for engaging the panel in sealing engagement upon securing the sealing device over the toggle-operated apparatus.

12. The sealing device of claim 1 wherein the apical section includes a collar configured and dimensioned for gripping the actuator of the toggle-operated apparatus in a sealing engagement upon mounting the boot member over the toggle-operated apparatus.

13. The sealing device of claim 12 including a sealing surface on the basal section for engaging the panel in sealing engagement upon securing the sealing device over the toggle-operated apparatus.

14. A sealing method for use in connection with sealing a toggle-operated apparatus with a sealing device, the toggle-operated apparatus being mounted upon a panel and having an actuator normally placed in an initial operating position wherein the actuator extends along a given axial direction away from the panel, the actuator being selectively movable in an angular displacement away from orientation in the given axial direction and into another operating position, in response to an operating force applied to the actuator in a transverse direction, transverse to the given axial direction, the sealing method comprising:

providing a boot member having a wall constructed of a resiliently flexible elastomeric material, the boot member including a lower basal section for establishing a seal at the panel, an upper apical section for establishing a seal at the actuator, and an intermediate section located axially between the basal section and the apical section, and providing the intermediate section with a cylindrical innermost wall portion juxtaposed with the apical section and extending substantially parallel to the axial direction;

a cylindrical outermost wall portion extending substantially parallel to the axial direction and spaced outward from the innermost wall portion in a transverse direction to establish a transverse spacing between the innermost wall portion and the outermost wall portion, with the outermost wall portion surrounding the inner wall portion; and a single intermediate wall portion having a substantially frusto-conical configuration spanning the transverse spacing and extending along a substantially straight line in an oblique direction making an acute angle with respect to the axial direction, from an axially upper end of the outermost wall portion directly to an axially lower end of the innermost wall portion, the wall portions providing the intermediate section with a cross-sectional configuration constructed to fold the innermost wall portion and the intermediate wall portion into close juxtaposition with one-another along a folded portion of the intermediate section upon angular displacement of the upper apical section away from orientation in the given axial direction, with the outermost wall portion remaining extended substantially parallel to the axial direction, the folded portion juxtaposed closely with the outermost wall portion and the intermediate wall portion remaining extended along the substantially straight line, while the innermost wall portion and the intermediate wall portion simultaneously are unfolded along a further portion of the intermediate section located transversely opposite from the folded portion, with the outermost wall portion remaining substantially parallel to the axial direction and the intermediate wall portion remaining extended along the substantially straight line, to facilitate angular displacement of the apical section, along with said angular displacement of the actuator, while reducing any resulting resilient biasing force within the boot member tending to return the apical section toward orientation in the given axial direction to less than any transversely directed force capable of moving the actuator out of the another operating position and toward initial operating position oriented in the given axial direction;

placing the boot member over the actuator; and securing the sealing device over the toggle-operated apparatus.

15. The sealing method of claim 14 including directing the oblique direction at an acute angle of about 45° to the axial direction.

16. The sealing method of claim 14 including providing the innermost, outermost and intermediate wall portions with a uniform wall thickness.

17. The sealing method of claim 14 including providing each of the innermost, outermost and intermediate wall portions with a wall thickness, and constructing at least the wall thickness of the intermediate wall portion with a wall thickness less than the wall thickness of the outermost wall portion.

* * * * *